United States Patent [19]

Bolton et al.

[11] Patent Number: 4,607,500

[45] Date of Patent: Aug. 26, 1986

[54] GRILLE MOUNTING FOR A ROOM AIR CONDITIONER

[75] Inventors: Theodore S. Bolton, Liverpool; Brad G. Leech, Fayetteville, both of N.Y.

[73] Assignee: Carrier Corporation, Syracuse, N.Y.

[21] Appl. No.: 778,114

[22] Filed: Sep. 20, 1985

[51] Int. Cl.[4] ..... F25D 23/12

[52] U.S. Cl. ..... 62/262; 62/297; 312/101

[58] Field of Search ..... 62/262, 263, 297; 312/101, 236

[56] References Cited

U.S. PATENT DOCUMENTS

| | | | |
|---|---|---|---|
| 3,665,727 | 5/1972 | Mather | 62/262 |
| 3,680,328 | 8/1972 | McCarty | 62/262 |
| 3,766,749 | 10/1973 | Livesay | 62/262 |
| 3,838,579 | 10/1974 | Ballard | 62/262 |
| 4,304,175 | 12/1981 | Lang et al. | 98/94 AC |
| 4,325,594 | 4/1982 | Lang et al. | 312/100 |
| 4,434,710 | 3/1984 | Bolton et al. | 98/94 AC |
| 4,555,983 | 12/1985 | Bolton et al. | 312/101 X |

*Primary Examiner*—Lloyd L. King

*Attorney, Agent, or Firm*—Dana F. Bigelow

[57] ABSTRACT

A plastic housing structure for an air conditioning system is provided with a plastic cover at its indoor end, with fastening means formed integrally with those structures such that no separate fastening devices are required. The overlapping skirt portion of the cover includes ribs with notches formed on the top and bottom sides of the skirt. The overlapped portion of the housing structure includes corresponding upwardly and downwardly extending flanges to engage with the notches to retain the cover in its installed position.

14 Claims, 4 Drawing Figures

GRILLE MOUNTING FOR A ROOM AIR CONDITIONER

BACKGROUND OF THE INVENTION

This invention relates generally to room air conditioners and, more particularly, to a grille structure for the indoor section of a room air conditioner.

A conventional room air conditioner comprises an outdoor section and an indoor section, with each having return air and air discharge openings. A grille structure is normally installed over each section to prevent the entry of foreign objects while allowing the free flow of air to and from the sections. The grille structure for the outdoor section is generally an integral part of the housing structure, whereas, to accommodate the easy access to the internal structure of the unit, the grille for the indoor section is normally secured to the chassis in such a manner as to allow for easy removal and replacement. The use of screws, clips, magnets, springs, and the like, is normally made for this purpose. These additional parts not only add cost to the system but also complicate and add time to the repair and/or maintenance procedures.

It is, therefore, an object of the present invention to provide an improved method and apparatus for mounting a grille to an air conditioning unit.

Another object of the present invention is the provision for a grille mounting structure that is simple in design, economical to manufacture and extremely functional in use.

These objects and other features and advantages become more readily apparent upon reference to the following description when taken in conjunction with the appended drawings.

SUMMARY OF THE INVENTION

Briefly, in accordance with one aspect of the invention, an indoor section of an air conditioning system is provided with a grille structure which includes a planar element having vents formed therein for conducting the flow of air to the return air opening and from the air discharge opening, and a skirt element attached to and extending rearwardly from the edges of said planar element on at least two opposite sides thereof to wrap around at least two sides of the indoor section, each of said two skirt element sides being flexibly movable in the transversely outward direction and having at least one transversely extending notch formed therein. At least one transversely extending flange is formed on each of said two sides of the indoor section, at longitudinal positions corresponding to those of said notches when the grille structure is in place, said flanges being engageable in said notches when said skirt element sides are flexed transversely outwardly and then released transversely inwardly to thereby maintain the grille structure in its installed position.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
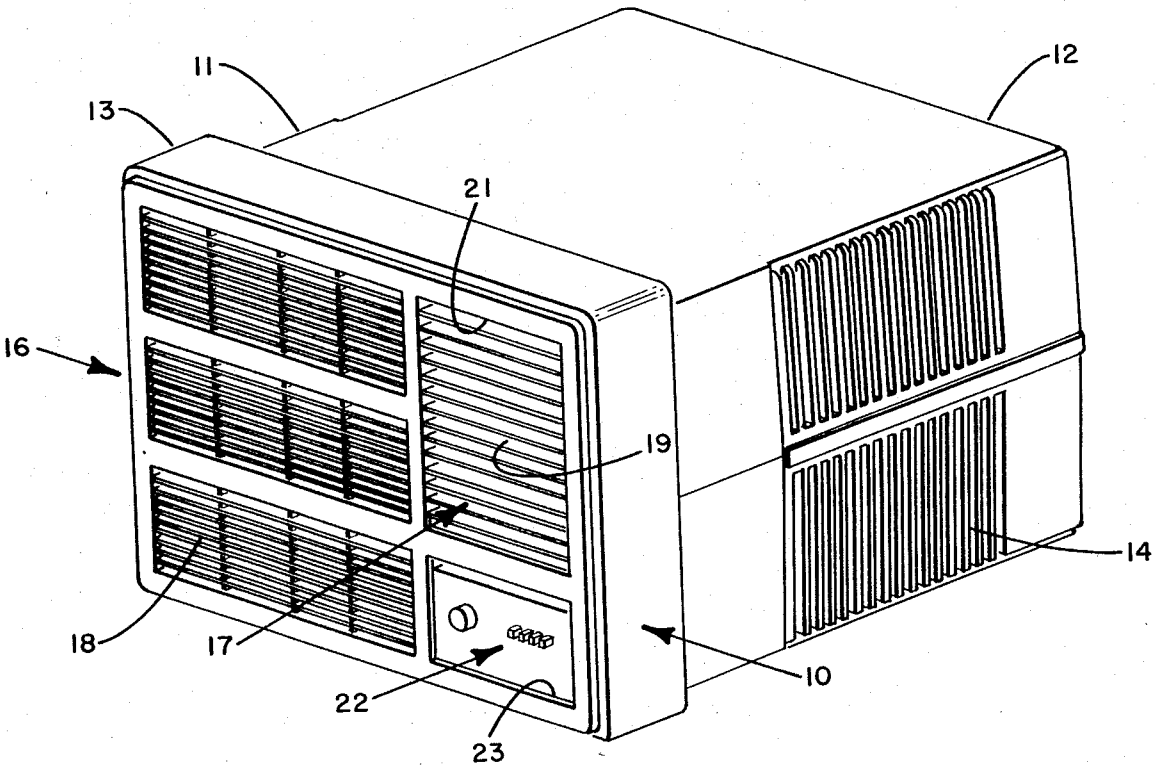
FIG. 1 is a perspective view of an air conditioner system with a grille structure in accordance with a preferred embodiment of the present invention.

Referring now to FIG. 1, the invention is shown generally at 10 as part of an otherwise conventional room air conditioner unit 11 which includes a molded cabinet 12 and a front cover structure 13. The cabinet 12 houses an indoor section, nearest the front cover 13, and an outdoor section at the outer or rear portion thereof. When the unit is in its installed position within a wall opening, the outdoor portion thereof operates to draw outdoor air in through the air intake openings 14 and force air out by the condenser fan through the condenser coil and out the discharge openings at the rear (not shown).

On the indoor side, the warm room air is drawn in through the return air openings 16 to pass through the evaporator coil to be cooled and then discharged from the air discharge opening 17. The return air opening 16 is covered by fixed louvers 18 that are integrally attached to the front cover structure 13, while the air discharge opening 17 is covered by an adjustable louver structure 19, such louver structure being separate from, but surrounded by the rectangular framework 21 of the front cover structure 13. Similarly, the control panel 22 is a separate component which is installed in the indoor section and then surrounded by the rectangular opening 23 of the front grille structure 13.

Figure 2:
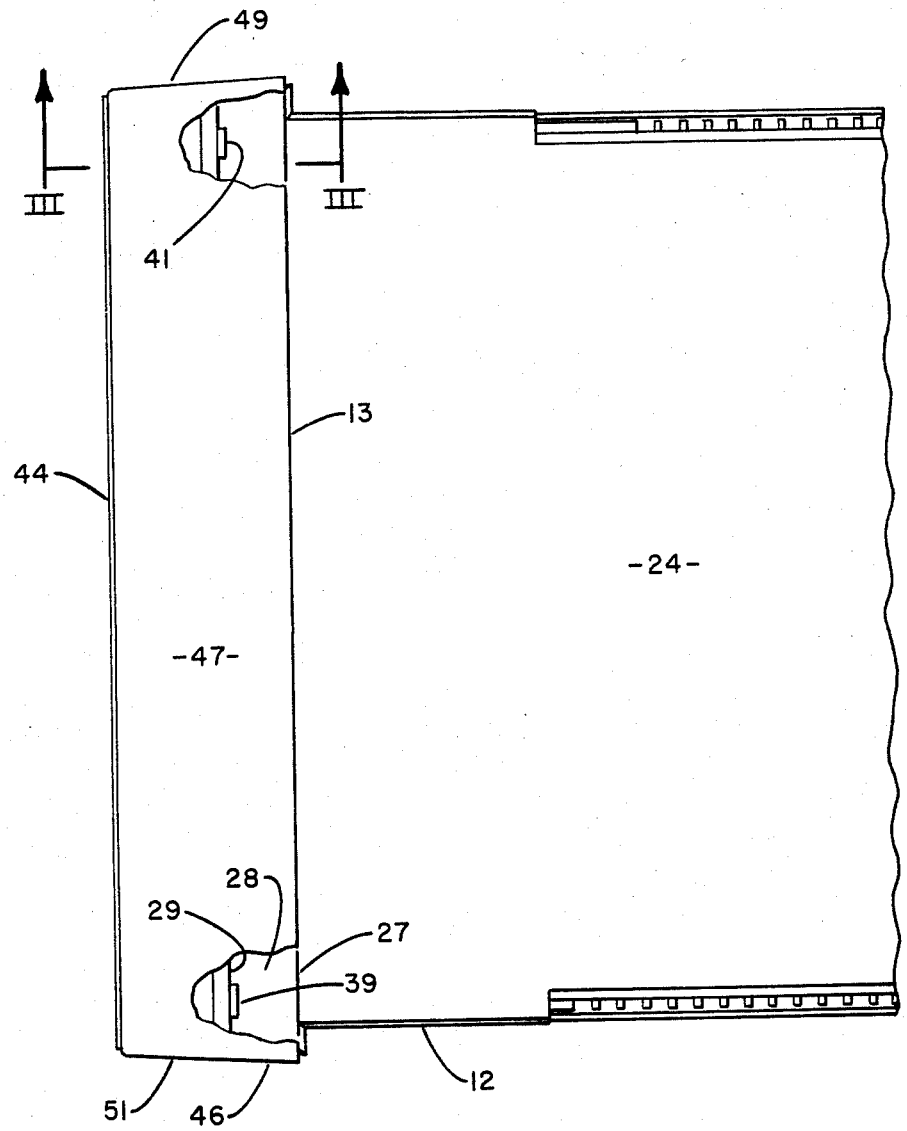
FIG. 2 is a top view thereof with a portion broken away to show the fastening arrangement in accordance with the present invention.
Figure 3:
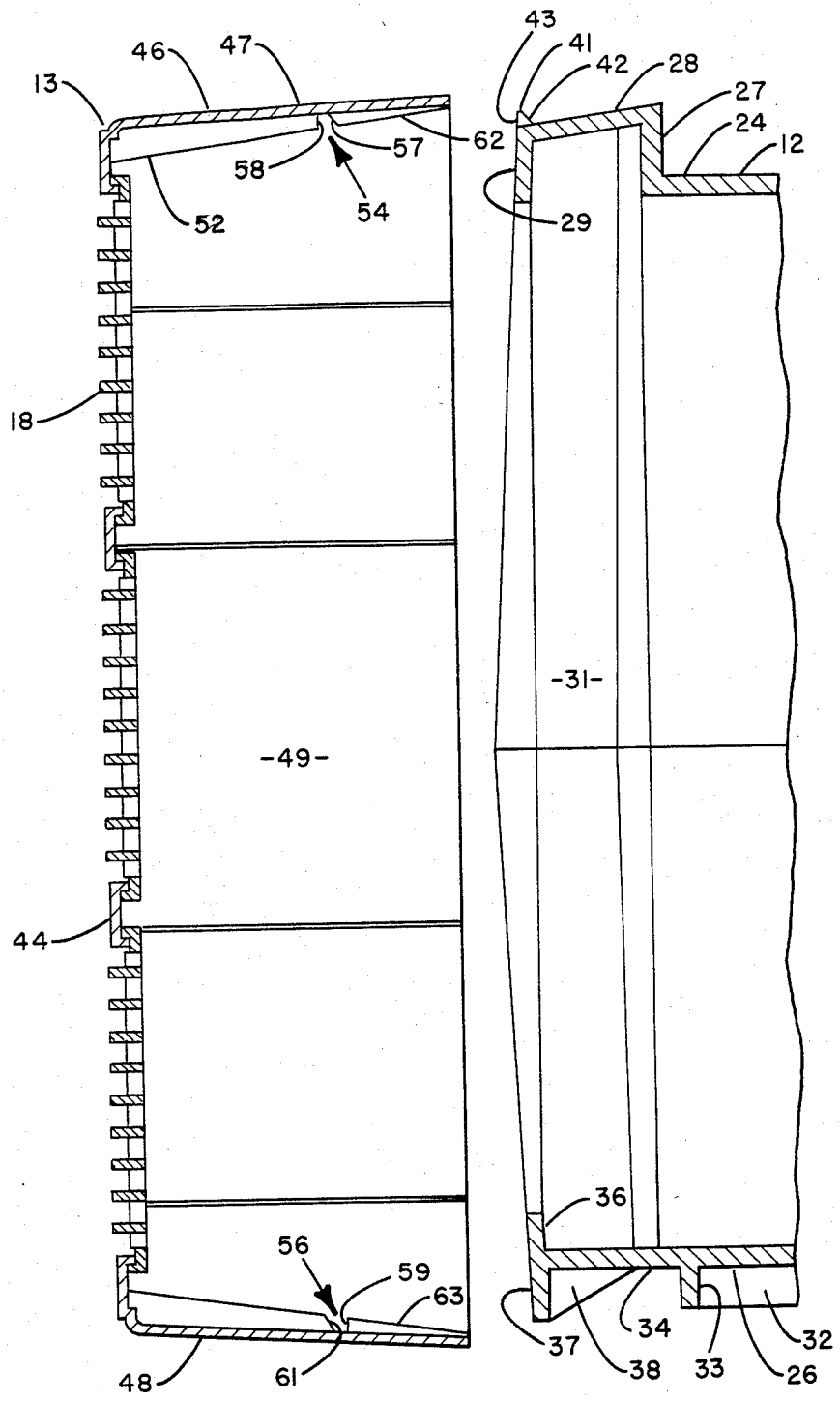
FIG. 3 is a partial exploded view of the grille and air conditioning housing portions of the present invention as seen along lines 3—3 of FIG. 2.
Figure 4:
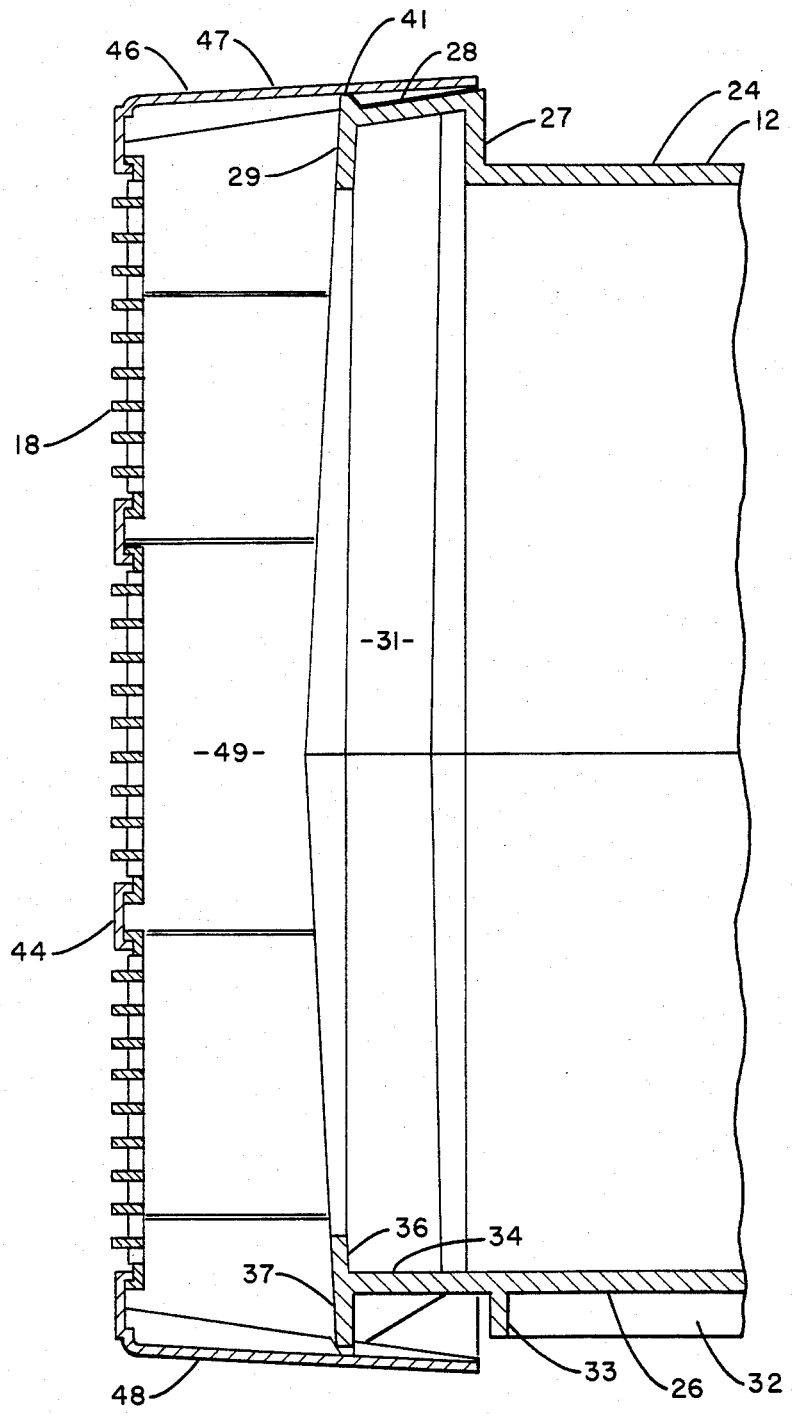
FIG. 4 is a partial sectional view thereof with the grille structure installed on the housing structure.

Referring now to FIGS. 2 and 3, the structural features for retaining the front cover structure 13 in its installed position on the front end of the cabinet 12 will now be described. The cabinet 12 includes an upper wall 24 and a lower wall 26. The upper wall 24 includes an upwardly extending member 27 which is adapted to be placed in close fit relationship with the inside surface of the wall of the space to be air conditioned. Extending forwardly from the member 27 is an extension member 28 which is adapted for extending into the room. As will be seen, its surface is sloped slightly downwardly toward its inner end 29. Cabinet side walls then interconnect the upper wall 24 and lower wall 26, the one side wall being shown at 31 in FIGS. 3 and 4.

A sidewall portion 32 extends downwardly below the lower wall 26. Associated with the side wall portion 32 is a transversely extending support wall 33 which extends downwardly from the lower wall 26 to provide structural rigidity and to act as a support member for use in installing the unit in a wall opening. The lower wall 26 then has a portion 34 which extends forwardly to the upwardly and downwardly extending T-members 36 and 37, respectively. The side wall 31 has a downwardly extending portion 38 which provides structural support for the downwardly extending T-member 36. All of the members 34, 36, 37 and 38 extend into the space to be air conditioned.

Returning again to the cabinet upper wall 24, there is shown in FIGS. 2 and 3 a pair of flanges 39 and 41 extending upwardly from the extension member 28. Each of the flanges 39 and 41 has a beveled lead-in surface 42 on its rear side and a generally vertically aligned surface 43 on its front side, as shown in FIG. 3. These flanges are employed to secure the front cover 13 to the cabinet 12 in a manner to be described hereinafter.

The front cover 13 is, like the cabinet 12, preferably formed of a plastic material by a conventional process such as injecting molding, for example. In addition to its front planar member 44, which is primarily comprised of the grille structure 18, the front cover 13 includes a skirt portion 46 which extends rearwardly from the planar member 44 and comprises upper wall 47, lower wall 48, and side walls 49 and 51, all of which flare slightly outwardly toward the rear as shown in FIG. 3.

Disposed on the inner side of the front cover skirt portion 46 is a plurality of inwardly extending ribs, two of which are shown at 52 and 53, which provide structural rigidity to the front cover 13 and also provide the interface structure for securing the cabinet front cover 13 to the cabinet 12. The ribs 52 and 53 include upper and lower notches 54 and 56, respectively, for that purpose. The upper notches 54 include a beveled lead-in surface 57 on the rear side and a substantially vertical surface 58 on the front side thereof. The lower notches 56 include a substantially vertical rear edge 59 and a beveled forward edge 61.

Installation of the cabinet front cover 13 to the cabinet 12 is accomplished as follows. The front cover is tilted with its top leaning away from the cabinet 12 and the skirt portion lower wall 48 is wrapped around the downwardly extending T-member 37, such that the rear edge of the lower wall 48 is near the support wall 33 of the cabinet 12 and the downwardly extending T-member 37 is either in the lower notches 56 or forward of the beveled edge 61. If it is in fact forward of the notches 56, then, as the skirt portion upper wall 47 is moved toward the cabinet 12, the forward beveled edge 61 allows the downwardly extending T-member 37 to easily slip into the lower notches 56 of the lower wall 48. Similarly, at the upper wall 47, the beveled lead-in surface 57 allows the flanges 39 and 41 to easily slip into the upper notches 54 such that the beveled surfaces 42 of the flanges 39 and 41 are mated with the beveled surfaces 57 in the notches 54, and the vertical surfaces 43 of the flanges 39 and 41 are mated with the vertical surfaces 58 of the notches 54. The cover 13 is shown in its installed position in FIG. 4.

It will be recognized that, in order for the flanges to be inserted into their respective notches, it is necessary that the upper and lower walls 47 and 48 be slightly deformed upwardly and downwardly, respectively. This is accomplished by sliding a beveled portion 62 (see FIG. 3) of the ribs 52 over the flanges 39 and 41, and possibly by additionally sliding the beveled portion 63 of the ribs 53 over the downwardly extending T-member 37.

Removal of the cover 13 from the cabinet 12 can be accomplished by simply pushing the front cover 13 upwardly to slightly deform the lower wall 48, and possibly the upper wall 47, outwardly to allow the flanges 39 and 41 to become disengaged from the notches 54. The downwardly extending T-member can then be easily disengaged from the lower notches 56.

While the present invention has been disclosed with particular reference to a preferred embodiment, the concepts of this invention are readily adaptable to other embodiments, and those skilled in the art may vary the structure thereof without departing from the essential spirit of the present invention.

What is claimed is:

1. In an air conditioning system of the type having indoor and outdoor sections extending longitudinally inwardly and outwardly, respectively, from a wall opening, with each section having air intake and air discharge openings, an improved grille attachment structure for covering the air intake and discharge openings of the indoor section comprising:

a planar element having vents formed therein for conducting the flow of air to the air intake opening and from the air discharge opening:

a skirt element attached to and extending rearwardly from the edges of said planar element, on at least two opposite sides thereof, to wrap around at least two sides of the indoor section, each of said at least two skirt element sides being flexibly movable in the transversely outward direction and having at least one transversely extending notch formed therein, and at least one transversely extending flange formed on each of said at least two sides of the indoor section, and longitudinal positions corresponding to those of said notches when the grille structure is in place, said flanges being engageable in said notches when said skirt element sides are flexed transversely outwardly and then released transversely inwardly to thereby maintain the skirt element and attached planar element in their installed positions.

2. A grille attachment structure set forth in claim 1 where said flanges and said notches are located at the tops and bottoms of said indoor section and skirt element, respectively.

3. A grille attachment structure set forth in claim 2 wherein said at least one bottom notch has a beveled lead-in surface on the side of the notch nearest the planar grille element.

4. A grille attachment structure as set forth in claim 2 wherein said at least one top notch has a beveled lead-in surface on the side of the notch farthest from the planar grille element.

5. A grille attachment structure as set forth in claim 4 wherein said at least one top flange has a beveled surface on its longitudinally outward surface.

6. A grille attachment structure as set forth in claim 1 wherein said skirt element includes longitudinally extending ribs in which said notches are formed.

7. A grille attachment structure as set forth in claim 6 wherein said longitudinally extending ribs are beveled in the longitudinal plane, with the flanges being gradually thicker toward said planar grille element.

8. An improved grille and attachment structure for an air conditioning system of the type having outdoor and indoor sections contained in a housing having an opening at the indoor end thereof comprising:

a cover for placement over the opening and attachment to the housing, said cover including a planar element disposed generally across said opening and a skirt element attached to said planar element with an overlapping portion extending rearwardly to overlap a portion of said housing, said skirt element being elastically deformable in the outward direction away from said opening;

at least one flange formed on each of two opposing sides of said overlapped housing portion, said flanges extending generally outwardly away from said opening; and at least one notch formed on each of two opposing sides of said skirt element overlapping portion, said notches being located in positions corresponding to those of said flanges when the cover is placed in position for attachment such that, when the cover is so placed, said skirt element can be elastically deformable to allow said flanges to engage said notches and the skirt element can return to its original shape to be held in place by the interaction of said flanges and notches.

9. A grille and attachment structure as set forth in claim 8 wherein said notches and flanges are located in the tops and bottoms of said cover and housing, respectively.

10. A grille and attachment structure as set forth in claim 9 wherein said at least one bottom notch has a beveled lead-in surface on the side of the notch nearest said cover planar element.

11. A grille and structure as set forth in claim 9 wherein said at least one top notch has a beveled lead-in surface on the side of the notch farthest from said cover planar surface.

12. A grille and attachment structure as set forth in claim 11 wherein said at least one top flange includes a beveled surface on the side of said flanges farthest from said cover planar element.

13. A grille and attachment structure as set forth in claim 8 and including a plurality of ribs formed on the inner side of said skirt element, said ribs being tapered with decreasing thickness as they extend rearwardly from said planar element.

14. A grille attachment structure as set forth in claim 13 wherein said notches are formed in said ribs.

* * * * *